US007859506B2

(12) United States Patent
Kang et al.

(10) Patent No.: US 7,859,506 B2
(45) Date of Patent: Dec. 28, 2010

(54) LIQUID CRYSTAL DISPLAY DEVICE AND METHOD FOR DISPLAYING A LANDSCAPE MODE IMAGE

(75) Inventors: Won-Sik Kang, Seoul (KR); Jong-Kon Bae, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 669 days.

(21) Appl. No.: 11/758,178

(22) Filed: Jun. 5, 2007

(65) Prior Publication Data

US 2007/0285372 A1 Dec. 13, 2007

(30) Foreign Application Priority Data

Jun. 9, 2006 (KR) ..... 10-2006-0051759

(51) Int. Cl.
*G09G 3/36* (2006.01)

(52) U.S. Cl. ..... 345/99; 345/94; 345/96

(58) Field of Classification Search ..... None
See application file for complete search history.

(56) References Cited

U.S. PATENT DOCUMENTS 5,966,116 A * 10/1999 Wakeland ..... 345/658
6,297,795 B1 10/2001 Kato et al.
7,079,129 B2 * 7/2006 Shigeta ..... 345/213
7,453,431 B2 * 11/2008 Ryuh ..... 345/96
2001/0045943 A1 * 11/2001 Prache ..... 345/204
2002/0063675 A1 * 5/2002 Furuhashi et al. ..... 345/98
2003/0018054 A1 * 1/2003 Yotsuya et al. ..... 514/340
2004/0150605 A1 * 8/2004 Arimoto et al. ..... 345/100
2004/0169626 A1 * 9/2004 Nakamura et al. ..... 345/87
2005/0140634 A1 * 6/2005 Takatori ..... 345/96

FOREIGN PATENT DOCUMENTS

JP 2005148364 6/2005
KR 1020060004427 A 1/2006
WO 2004066616 8/2004

* cited by examiner

*Primary Examiner*—Bipin Shalwala
*Assistant Examiner*—Daniel Bedell
(74) *Attorney, Agent, or Firm*—Volentine & Whitt, PLLC

(57) ABSTRACT

A mobile LCD device controls a common voltage signal VCOM to effectively display a landscape mode image instead of using a separate integrated chip (IC). The LCD device utilizes a method of displaying a landscape mode image including selecting a video frame from M video frames received from an external source where M is greater than or equal to 2. The selected video frame is stored in a video memory. The selected video frame is masked so as not to display the selected video frame while the selected video frame is stored. The stored video frame is displayed a predetermined number of times while the selected video frame is not stored thereby effectively displaying the landscape mode image.

18 Claims, 7 Drawing Sheets

LIQUID CRYSTAL DISPLAY DEVICE AND METHOD FOR DISPLAYING A LANDSCAPE MODE IMAGE

CROSS-REFERENCE TO RELATED APPLICATION

This U.S. non-provisional patent application claims priority under 35 USC §119 of Korean Patent Application No. 2006-51759 filed on Jun. 9, 2006 the entire contents of which are hereby incorporated by reference.

BACKGROUND OF THE INVENTION

1. Field of the Invention

The present invention relates to displaying landscape mode images. More particularly, embodiments of the invention relate to a method of effectively managing the display of a landscape mode image utilizing a timing controller and a mobile liquid crystal display (LCD) device.

2. Discussion of Related Art

Liquid crystal display (LCD) devices have been utilized in desktop computers and mobile devices such as cellular phones and palmtop computers. LCDs used in mobile devices (hereinafter referred to as a "mobile LCD device") have low manufacturing costs and require low power consumption. Mobile LCD devices are also designed to optimize the display of a portrait mode image rather than a landscape mode image.

FIG. 1 is a timing diagram illustrating a set of signals used when a conventional mobile LCD device displays a single video frame. A set of signals needed when a single video frame is displayed includes a vertical synchronization signal VSYNC, a horizontal synchronization signal HSYNC and a data enable signal DE. The vertical synchronization signal VSYNC 110 is used for representing a starting point of the single video frame. The mobile LCD device displays the single video frame when the vertical synchronization signal VSYNC is active. Horizontal synchronization signal HSYNC 120 is used for representing a starting point of a single horizontal line of the single video frame. The mobile LCD device displays the single horizontal line when the horizontal synchronization signal HSYNC is active. When the vertical synchronization signal VSYNC 110 is generated once, a plurality of horizontal synchronization signals HSYNCs are generated. Data enable signal DE 130 is used for representing a starting point of data transmission in the single horizontal line. Data corresponding to the single horizontal line is transmitted to the mobile LCD when the data enable signal DE is active.

FIG. 2 is a diagram for illustrating a procedure where a video frame is read from or written to a video memory when a mobile LCD device displays a landscape mode image. First, when a portrait mode image is written into video memory 210, the image is written in horizontal direction 230. When a landscape mode image is written into video memory 210, the image is written in a vertical direction 220. This is because the mobile LCD device is optimized for supporting the portrait mode. When the portrait mode image is read from video memory 210, the image is read in a horizontal direction 230. Similarly, when the landscape mode image is read from video memory 210, the image is also read in horizontal direction 230. Thus, the mobile LCD device reads the video frame in a horizontal direction 230 from video memory 210 regardless of whether the image mode is portrait or landscape.

FIG. 3 is a timing diagram illustrating a set of signals used when a conventional mobile LCD device displays a landscape mode image. A set of signals used when the mobile LCD device displays a landscape mode image includes a vertical synchronization signal VSYNC 310, an external data enable signal EXTERNAL_DE 320, an internal data enable signal INTERNAL_DE 330, a display output signal DO 340 and a common voltage signal VCOM 350. Vertical synchronization signal VSYNC 310 is used for representing a starting point of a single video frame. The mobile LCD device displays the single video frame when the vertical synchronization signal VSYNC is active. For example, the mobile LCD device may receive 60 vertical synchronization signals VSYNCs per second. A horizontal synchronization signal HSYNC (not illustrated) is used for representing a starting point of a single horizontal line of the single video frame. The mobile LCD device displays the single horizontal line when the horizontal synchronization signal HSYNC is active. When the vertical synchronization signal VSYNC 310 is generated once, a plurality of horizontal synchronization signals HSYNCs are generated.

External data enable signal EXTERNAL_DE 320 is used for representing a starting point of data transmission in the single horizontal line. Data corresponding to the single horizontal line is transmitted to the mobile LCD device when the external data enable signal EXTERNAL_DE is active. Internal data enable signal INTERNAL_DE 330 is used for representing a starting point of data storage in the single horizontal line. The data is stored into the video memory when the internal data enable signal INTERNAL_DE 330 is active. For example, when four external data enable signals EXTERNAL_DEs are generated, one internal data enable signal INTERNAL_DE may be generated. That is, the mobile LCD device receives the four frame data and may select one of the four frame data to store the selected one. Display output signal DO 340 represents a starting point of outputting of the video frame. The video frame is read from the video memory when the display output signal DO 340 is active. However, display output signal DO 340 is masked when internal data enable signal INTERNAL_DE 320 is active. Common voltage signal VCOM 350 is used for updating a display in the mobile LCD device. The mobile LCD device displays the video frame when the common voltage signal VCOM 350 is changed from a high voltage to a low voltage or from a low voltage to a high voltage.

In general, a period of common voltage signal VCOM 350 is equal to that of display output signal DO 340. Common voltage signal VCOM 350 is changed 80 times per second in order for the mobile LCD device to display 60 video frames per second. This is because the video frame is masked when internal data enable signal INTERNAL_DE 330 is active. However, if common voltage signal VCOM 350 is changed while internal data enable signal INTERNAL_DE 320 is active, a display problem in the mobile LCD device occurs.

FIGS. 4A, 4B and 4C are diagrams illustrating such a problem when a conventional mobile LCD device displays a landscape mode image. FIG. 4A represents an original video frame stored in the mobile LCD device. FIGS. 4B and 4C represent video frames that may occur if common voltage signal VCOM 350 is changed while internal data enable signal INTERNAL_DE 330 is active. The noise illustrated in FIGS. 4B and 4C occurs because the direction in which the video frame is written into the video memory is not the same as the direction in which the video frame is read from the video memory. Accordingly, there is a need for providing an LCD device for effectively displaying a landscape mode image.

SUMMARY OF THE INVENTION

Exemplary embodiments of the present invention are directed to a method of displaying a landscape mode image. In one exemplary embodiment, a mobile liquid crystal display (LCD) device is used to display a landscape mode image and includes a display panel, a source driver, a gate driver, a driving voltage generator and a timing controller. The display panel has a plurality of gate lines and a plurality of data lines. The source driver is coupled to the display panel and configured to drive the data lines. The gate driver is coupled to the display panel and is configured to drive the gate lines of the display panel. The driving voltage generator is coupled to the gate driver and the display panel and is configured to provide a common voltage signal to the display panel. The driving voltage generator is further configured to provide a control voltage to the gate driver. The timing controller is configured to control a drive timing of the source driver, the gate driver and the driving voltage generator. The timing controller has a video memory configured to store a video frame that is selected from a plurality of video frames received from an external source and a driver controller configured to control a common voltage signal so as not to display the video frame while the video frame is stored into the video memory. The timing controller repeatedly displays the video frame a predetermined number of times while the video frame is not stored.

In another exemplary embodiment, a method is used to display a landscape mode image and includes selecting a video frame from M video frames received externally where M is greater than or equal to 2. The method further includes storing the selected video frame into a video memory and masking only the selected video frame so as not to display the selected video frame while the selected video frame is stored. The method also further includes displaying the stored video frame a predetermined number of times while the selected video frame is not stored.

In still another exemplary embodiment, a timing controller is used to display a landscape mode image and includes a video memory and a driver controller. The video memory is configured to store a video frame selected from a plurality of video frames received from an external source. The driver controller is coupled to said video memory and is configured to control a common voltage signal so as not to display the video frame while the video frame is stored into said video memory, said driver controller further configured to repeatedly display the video frame a predetermined number of times while the video frame is not stored

DESCRIPTION OF EMBODIMENTS

Figure 1:
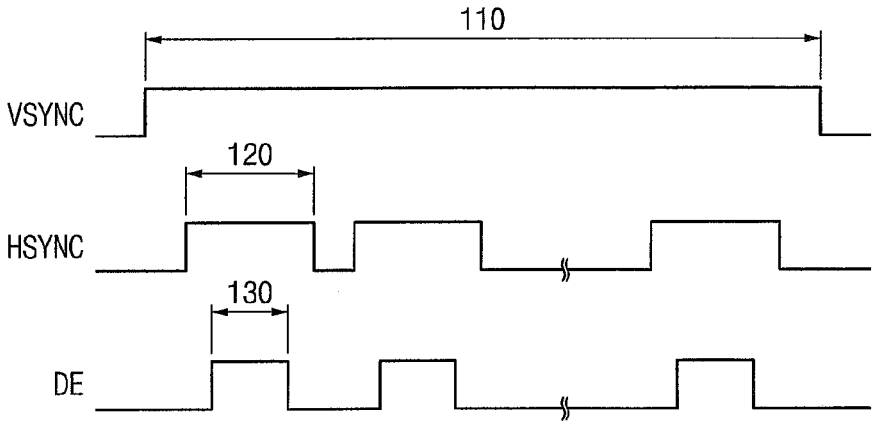
FIG. 1 (CONVENTIONAL ART)
FIG. 1 is a timing diagram illustrating a set of signals used when a conventional mobile liquid crystal display (LCD) device displays a single video frame.
Figure 2:
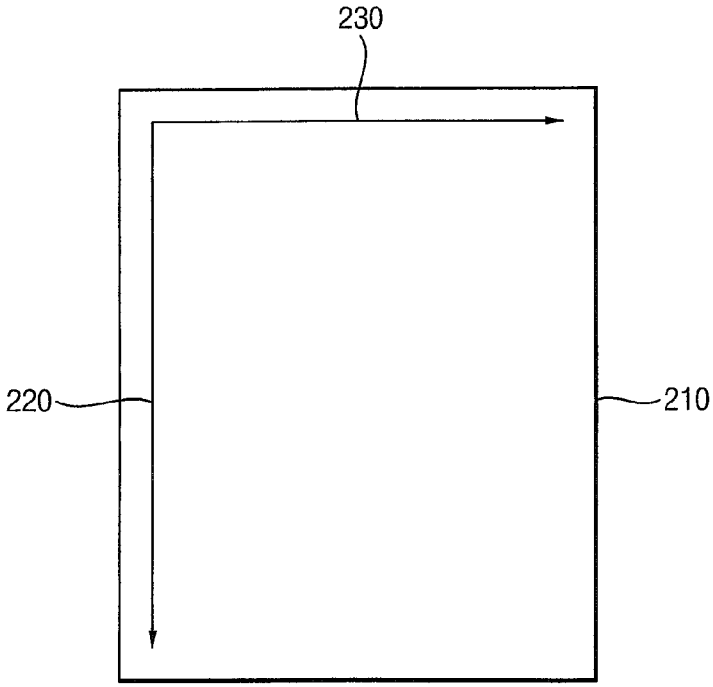
FIG. 2 (CONVENTIONAL ART)
FIG. 2 is a diagram for illustrating a procedure where a video frame is read from/written to video memory when a mobile LCD device displays a landscape mode image.
Figure 3:
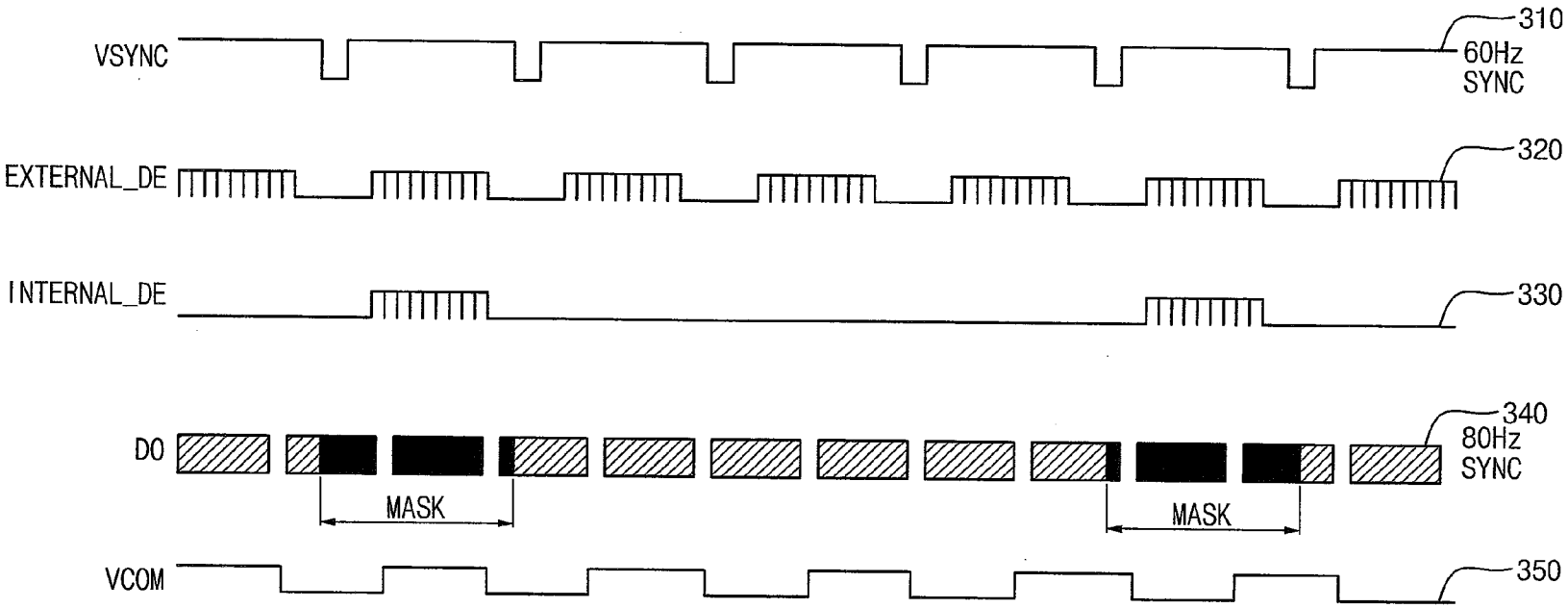
FIG. 3 (CONVENTIONAL ART)
FIG. 3 is a timing diagram illustrating a set of signals used when a conventional mobile LCD device displays a landscape mode image.
Figure 4A:
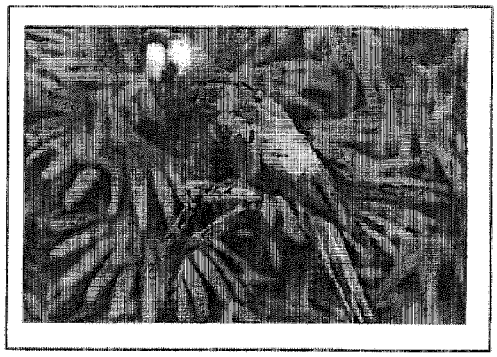
FIG. 4A (CONVENTIONAL ART)
FIGS. 4A, 4B and 4C are diagrams for illustrating a problem when a conventional mobile LCD device displays a landscape mode image.
Figure 4B:
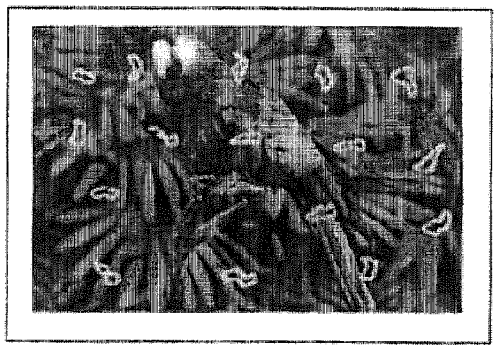
FIG. 4B (CONVENTIONAL ART)
Figure 4C:
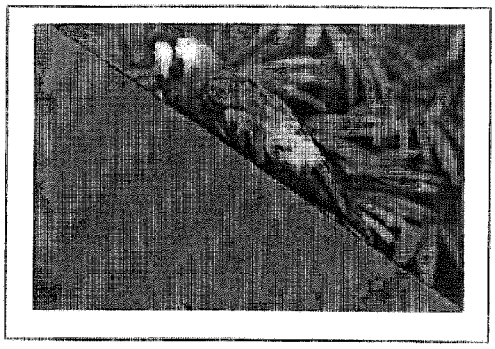
FIG. 4C (CONVENTIONAL ART)

The present invention will now be described more fully hereinafter with reference to the accompanying drawings, in which preferred embodiments of the invention are shown. This invention, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. When an element is referred to as being "connected" or "coupled" to another element, it can be directly connected or coupled to the other element or intervening elements may be present.

Figure 5:
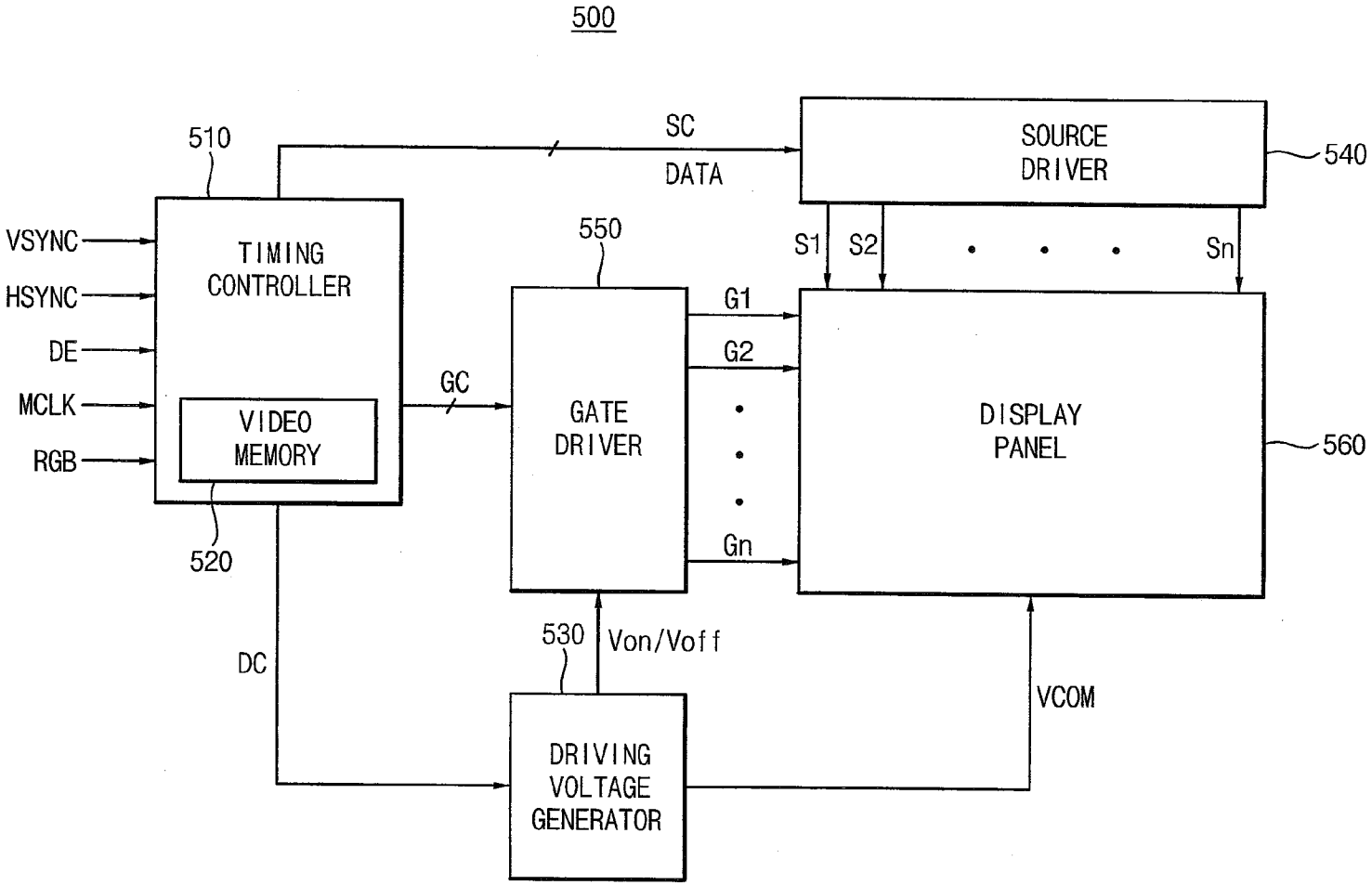
FIG. 5 is a block diagram illustrating a configuration of a mobile LCD device according to an exemplary embodiment of the present invention.

FIG. 5 is a block diagram illustrating a mobile liquid crystal display (LCD) device 500 including a timing controller 510 having video memory 520, a driving voltage generator 530, a source driver 540, a gate driver 550 and a display panel 560. Timing controller 510 receives a vertical synchronization signal VSYNC, a horizontal synchronization signal HSYNC, a data enable signal DE, a clock signal MCLK and video data RGB. Timing controller 510 controls driving voltage generator 530, source driver 540 and gate driver 550 to display a video frame via display panel 560.

Timing controller 510 receives video data RGB and generates the video frame based on video data RGB to store the generated video frame into video memory 520. For example, timing controller 510 stores a specific video frame in video frames received externally into video memory 520. Video memory 520 may be included in timing controller 510 or may be placed anywhere in the mobile LCD device. Driving voltage generator 530 receives a driving voltage generation control signal DC from timing controller 510. Driving voltage generator 530 generates a gate on/off signal Von/Voff and common voltage signal VCOM to control gate driver 550 and display panel 560. Common voltage signal VCOM is used for updating the video frame displayed in display panel 560. Display panel 560 updates the video frame when common voltage signal VCOM is changed.

Source driver 540 receives single line DATA in the video frame and a source control signal SC from timing controller 510, and outputs the single line DATA to display panel 560 according to source control signal SC. Gate driver 550 receives gate control signal GC from timing controller 510 and gate on/off signal Von/Voff from driving voltage generator 530. Gate driver 550 controls display panel 560 so that the single line outputted from source driver 540 is sequentially outputted to each horizontal line of display panel 560. In this manner, display panel 560 displays the video frame and is controlled by source driver 540, gate driver 550 and driving voltage generator 530.

Figure 6:
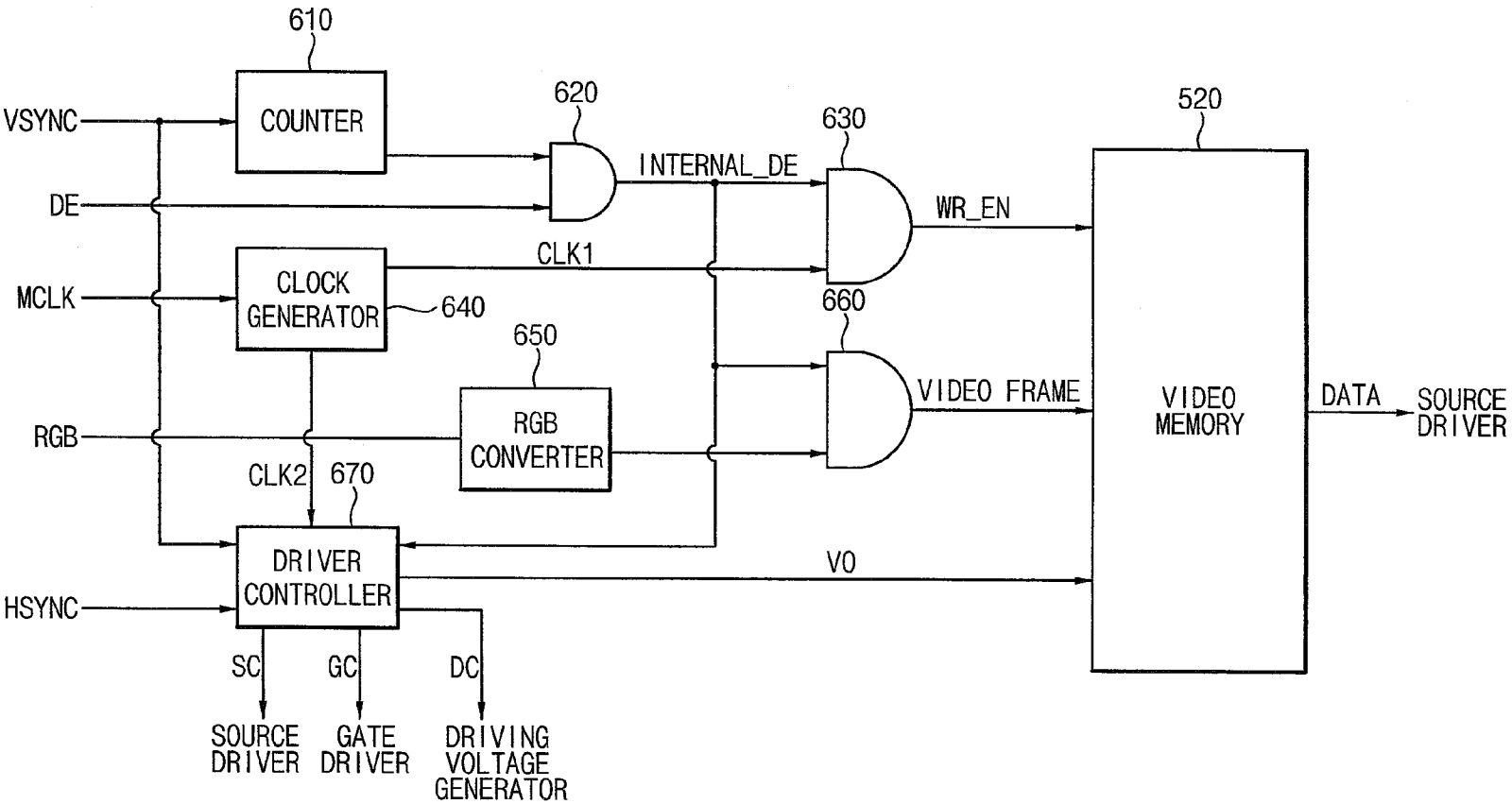
FIG. 6 is a block diagram illustrating the timing controller in FIG. 5.

FIG. 6 is a block diagram illustrating the timing controller 510 including counter 610, first AND gate 620, second AND gate 630, clock generator 640, red-green-blue (RGB) converter 650, third AND gate 660, driver controller 670 and video memory 520. Counter 610 receives signal VSYNC to perform a count operation on the number of vertical synchronization signals. For example, counter 610 may perform a count operation on the number of the vertical synchronization signals VSYNCs to determine a time for storing the specified video frame. Assuming that 80 video frames are received per second and the mobile LCD device outputs the 80 video frames per second, one of four video frames may be stored and the other three may be displayed so that the mobile LCD device displays 60 video frames per second. In another example, assuming that 60 video frames are received per second and the mobile LCD device outputs 80 video frames per second, one of four video frames may be stored and four frames may be displayed so that the mobile LCD device displays 60 video frames per second. When a first of four video frames received externally is stored in video memory 520, counter 610 outputs a logic high based on a multiple of 4.

The first AND gate 620 generates an internal data enable signal INERNAL_DE based on the signal outputted from counter 610 and a data enable signal DE received externally. For example, when the number of vertical synchronization signals VSYNCs counted corresponds to a multiple of 4 and the data enable signal DE is received, first AND gate 620 outputs the internal data enable signal INTERNAL_DE. Clock generator 640 receives clock MCLK externally and generates clocks CLK1 and CLK2 needed in timing controller 510. For example, clock generator 640 generates clock CLK1 for second AND gate 630 and clock CLK2 for driver controller 670. Clock CLK1 is used as a control signal for storing a video frame into video memory 520 and clock CLK2 is used for controlling driving voltage controller 530, source driver 540 and gate driver 550.

Second AND gate 630 receives internal data enable signal INTERNAL_DE from first AND gate 620 and clock CLK1 from clock generator 640. Second AND gate 630 outputs write enable signal WR_EN to video memory 520 such that second AND gate 630 informs video memory 520 of an amount of time for storing the video frame. RGB converter 650 receives video data RGB externally and generates the video frame from video data RGB. Third AND gate 660 receives the internal data enable signal INTERNAL_DE from first AND gate 620 and the video frame from RGB converter 650, and outputs the video frame to video memory 520 based on internal data enable signal INTERNAL_DE. Video memory 520 receives write enable signal WR_EN from second AND gate 630 and the video frame from third AND gate 660, and stores the video frame based on the write enable signal WR_EN. Video memory 520 also receives video data output signal VO from driver controller 670 and sequentially outputs a single line in the video frame to source driver 540.

Driver controller 670 receives clock CLK2, vertical synchronization signal VSYNC, horizontal signal HSYNC and internal data enable signal INTERNAL_DE, and generates source control signal SC for controlling source driver 540. Driver controller 670 also generates gate control signal GC for controlling gate driver 550. Also, driver controller 670 generates video data output signal VO for controlling an output of video memory 520. Driver controller 670 controls common voltage signal VCOM so that the video frame is not displayed in an interval where the video frame is stored and repeatedly displays the video frame a predetermined number of times in an interval where the video frame is not stored. For example, when driver controller 670 receives internal data enable signal INTERNAL_DE from first AND gate 620, driver controller 670 controls the driving voltage generation control signal DC so that common voltage signal VCOM is not changed. When driver controller 670 does not receive the internal data enable signal INTERNAL_DE from first AND gate 620, driver controller 670 controls the driving voltage generation control signal DC so that the common voltage signal VCOM is changed. Also, driver controller 670 outputs source control signal SC to source driver 540, gate control signal GC to gate driver 550 and video data output signal DO to video memory 520 to output the video frame stored in video memory 520.

Figure 7:
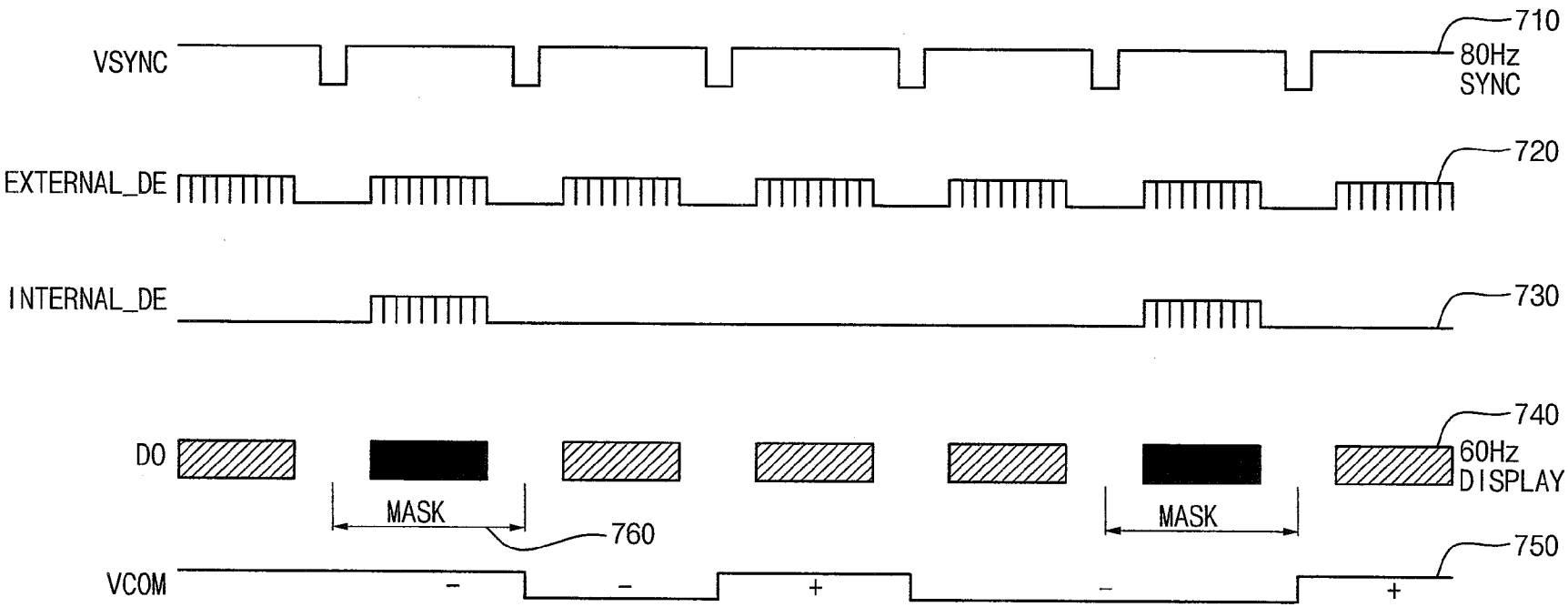
FIG. 7 is a timing diagram illustrating a set of signals used for one example operation of a timing controller.

FIG. 7 is a timing diagram illustrating a set of signals used for one exemplary operation of timing controller 510. A set of signals includes a vertical synchronization signal VSYNC 710, an external data enable signal EXTERNAL_DE 720, an internal data enable signal INTERNAL_DE 730, a display output signal DO 740 and a common voltage signal VCOM 750. Vertical synchronization signal VSYNC 710 is used for representing a starting point of a single video frame, and the mobile LCD device displays the single video frame when the vertical synchronization signal VSYNC is active. For example, mobile LCD device receives 80 vertical synchronization signals VSYNCs per second so that a period of the vertical synchronization signal VSYNC is the same as that of display output signal DO 740. Horizontal synchronization signal HSYNC (not illustrated) is used for representing a starting point of a single horizontal line of the single video frame, and the mobile LCD device displays the single horizontal line when the horizontal synchronization signal HSYNC is active. When the vertical synchronization signal VSYNC 710 is generated once, a plurality of horizontal synchronization signals HSYNCs are generated.

External data enable signal EXTERNAL_DE 720 is used for representing a starting point of data transmission in the single horizontal line, and data corresponding to the single horizontal line is transmitted to the mobile LCD when the external data enable signal EXTERNAL_DE 720 is active. Internal data enable signal INTERNAL_DE 730 is used for representing a starting point of data storage in the single horizontal line and the data is stored into the video memory when the internal data enable signal INTERNAL_DE 730 is active.

In order to generate internal data enable signal INTERNAL_DE counter 610 receives the vertical synchronization signal VSYNC 710 and performs a count operation thereon. When a first video frame of video frames received externally is stored in video memory 520, counter 610 outputs a logic high based on a multiple of the number of video frames. For example, when four external data enable signals EXTERNAL_DE 720 are generated, the mobile LCD device may generate one internal data enable signal INTERNAL_DE 730. That is, the mobile LCD device receives four video frames and selects one of the four video frames to store the selected one. First AND gate 620 generates the internal data enable signal INTERNAL_DE based on a determination result of counter 610 and data enable signal DE received externally. Display output signal DO 740 represents a starting point for outputting the video frame. The video frame is read from video memory 520 when display output signal DO 740 is active. However, display output signal DO 740 is masked when internal data enable signal INTERNAL_DE 720 is active. For example, an unmasked display output signal DO 740 may be generated 60 times per second. That is, display output signal DO 740 is masked so as not to display the video frame when the video frame is stored in video memory 520 and is outputted when the video frame is not stored.

Driver controller 670 determines the video frame based on a multiple of the number of video frames and outputs a blank video frame based on the result. For example, blank video frame 760 may correspond to black data outputted to display panel 560 or may correspond to a previous video frame. Common voltage signal VCOM 750 is used for updating a display in the mobile LCD device. The mobile LCD device displays the video frame when the common voltage signal VCOM 750 is changed. In addition, the mobile LCD device displays the blank video frame when common voltage signal VCOM 750 is not changed.

By way of example, assuming that 80 video frames are received per second and the mobile LCD device outputs the 80 video frames per second, one of four video frames may be stored and three thereof may be displayed so that the mobile LCD device displays 60 video frames per second. Timing controller 510 receives the 80 video frames externally and selects one of four video frames to store the selected one into video memory 520. That is, counter 610 may perform a count operation on the video frames received externally and determines the video frame based on a multiple of 4. First AND gate 620 generates internal data enable signal INTERNAL_DE 730 based on the determination result of counter 610 and clock CLK1 and stores the video frame into video memory 520. When driver controller 670 receives internal data enable signal INTERNAL_DE from first AND gate 620, driver controller 670 controls the driving voltage generation control signal DC so that the common voltage signal VCOM is not changed. When internal data enable signal INTERNAL_DE 730 is active, driver controller 670 controls the driving voltage generation control signal DC such that common voltage signal VCOM 750 is unchanged. In this manner, the mobile LCD device displays the blank video frame.

When internal data enable signal INTERNAL_DE 730 is not active, driver controller 670 controls driving voltage generation control signal DC for changing the common voltage signal VCOM 750 so that the mobile LCD device repeatedly displays the video frame three times. As a result, driver controller 670 controls driving voltage generator 530, source driver 540 and gate driver 550 to display 60 video frames per second.

Figure 8:
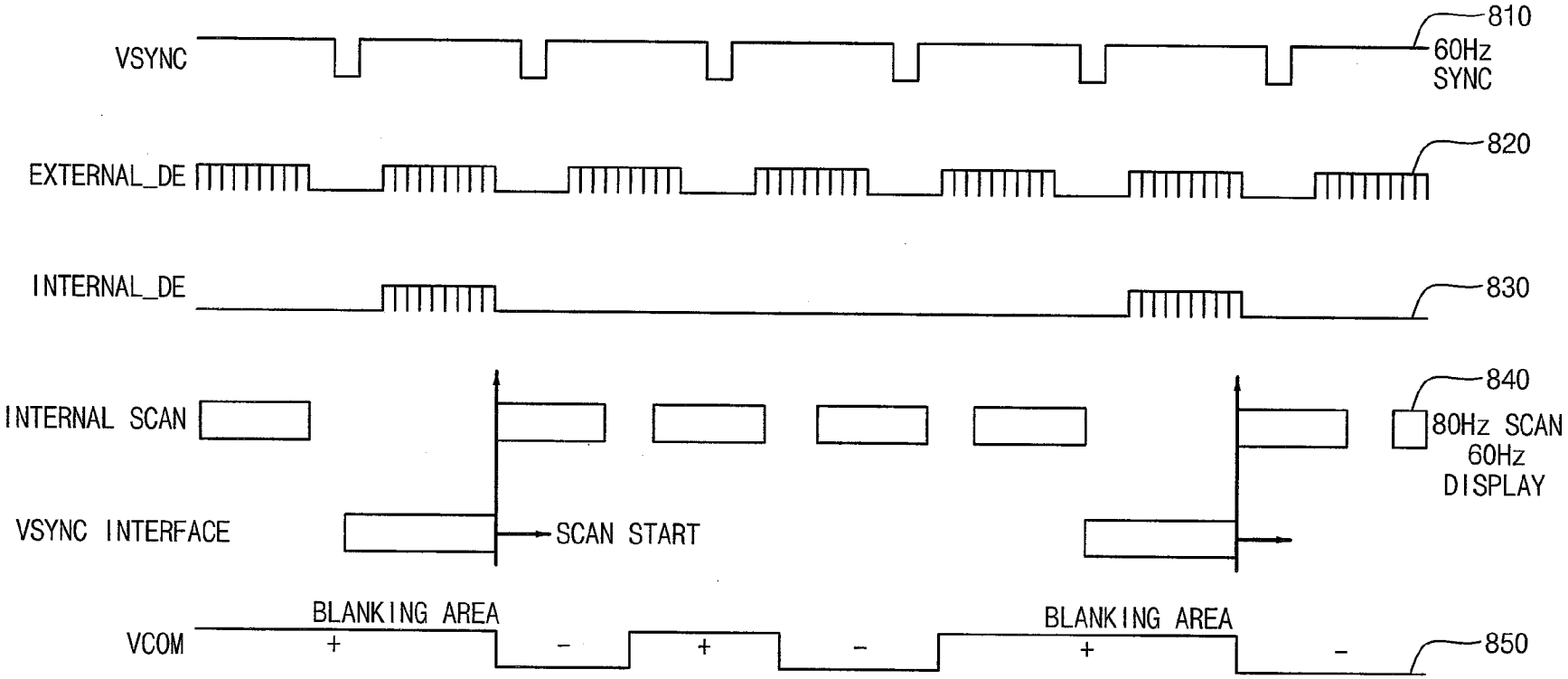
FIG. 8 is a timing diagram illustrating a set of signals used for another exemplary operation of a timing controller.

FIG. 8 is a timing diagram illustrating a set of signals used for an exemplary operation of timing controller 510. The set of signals includes a vertical synchronization signal VSYNC 810, an external data enable signal EXTERNAL_DE 820, an internal data enable signal INTERNAL_DE 830, a display output signal DO 840 and a common voltage signal VCOM 850. Vertical synchronization signal VSYNC 810 is used for representing a starting point of a single video frame and the mobile LCD device displays the single video frame when the vertical synchronization signal VSYNC is active. For example, the mobile LCD device receives 80 vertical synchronization signals VSYNCs per second. A horizontal synchronization signal HSYNC (not illustrated) is used for representing a starting point of a single horizontal line of the single video frame. The mobile LCD device displays the single horizontal line when the horizontal synchronization signal HSYNC is active. When the vertical synchronization signal VSYNC 810 is generated once, a plurality of horizontal synchronization signals HSYNCs are generated.

External data enable signal EXTERNAL_DE 820 is used for representing a starting point of data transmission in the single horizontal line. Data in the single horizontal line is transmitted to the mobile LCD when the external data enable signal EXTERNAL_DE 820 is active. Internal data enable signal INTERNAL_DE 830 is used for representing a starting point of data storage in the single horizontal line. The data is stored into the video memory when the internal data enable signal INTERNAL_DE 830 is active.

In order to generate internal data enable signal INTERNAL_DE, counter 610 receives vertical synchronization signal VSYNC 810 and performs a count operation thereon. When a first video frame of video frames received externally has to be stored into video memory 520, counter 610 outputs a logic high based on a multiple of the number of the video frames. For example, when four external data enable signals EXTERNAL_DE 820 are generated, the mobile LCD device may generate one internal data enable signal INTERNAL_DE 830. That is, the mobile LCD device receives four video frames and selects one of the four video frames to store the selected one. First AND gate 620 generates the internal data enable signal INTERNAL_DE based on a determination of counter 610 and data enable signal DE. Display output signal DO 840 is used for representing a starting point of outputting of the video frame. The video frame is read from video memory 520 when display output signal DO 840 is active. However, display output signal DO 840 is masked when internal data enable signal INTERNAL_DE 820 is active. For example, an unmasked display output signal DO 840 may be generated 60 times per second. Display output signal DO 840 is masked so as not to display the video frame when the video frame is stored in video memory 520 and is outputted when the video frame is not stored.

Driver controller 670 determines the video frame based on a multiple of the number of the video frames and outputs a blank video frame based on the result. For example, blank video frame 860 may correspond to black data outputted to display panel 560, or may correspond to a previous video frame. Common voltage signal VCOM 850 is used for updating a display in the mobile LCD device. The mobile LCD device displays the video frame when common voltage signal VCOM 850 is changed. In addition, the mobile LCD device displays the blank video frame when common voltage signal VCOM 850 is unchanged.

By way of another example, assuming that 60 video frames are received per second and the mobile LCD device outputs the 80 video frames per second, one of four video frames may be stored and four frames may be displayed so that the mobile LCD device displays 60 video frames per second. Timing controller 510 receives the 60 video frames externally, and selects one of four video frames to store the selected one in video memory 520. Counter 610 may perform a count operation on the externally received video frames and determines the video frame based on a multiple of 4. First AND gate 620 generates internal data enable signal INTERNAL_DE 830 based on the determination result of counter 610 and clock CLK1 to store the video frame into video memory 520. When driver controller 670 receives internal data enable signal INTERNAL_DE 830 from first AND gate 620, driver controller 670 controls the driving voltage generation control signal DC. In this manner, common voltage signal VCOM is unchanged.

When internal data enable signal INTERNAL_DE 830 is active, driver controller 670 controls driving voltage generation control signal DC. Common voltage signal VCOM 850 remains unchanged so that the mobile LCD device displays the blank video frame. When internal data enable signal INTERNAL_DE 830 is not active, driver controller 670 controls driving voltage generation control signal DC for changing the common voltage signal VCOM 850, so that the mobile LCD device repeatedly displays the video frame four times. As a result, driver controller 670 controls driving voltage generator 530, source driver 540 and gate driver 550 to display 60 video frames per second.

As described above, the mobile LCD device controls a common voltage signal VCOM to effectively display a landscape mode image instead of using a separate integrated chip (IC) for controlling the display of the landscape mode image.

Although the present invention has been described in connection with the embodiment of the present invention illustrated in the accompanying drawings, it is not limited thereto. It will be apparent to those skilled in the art that various substitution, modifications and changes may be thereto without departing from the scope and spirit of the invention.

What is claimed is:

1. A method of displaying a landscape mode image, comprising:

selecting a video frame from M video frames received externally where M is greater than or equal to 2;

storing the selected video frame into a video memory;

masking only the selected video frame so as not to display the selected video frame in a display panel while the selected video frame is undergoing a process of being stored in the video memory;

providing common voltage signal having a regular cycle of high and low voltage levels during periods in which the selected video frame is not masked, but during periods in which the selected video frame is masked maintaining the common voltage signal at a previous high or low voltage level through a next voltage level cycle, such that the selected video frame is not displayed in the display panel while the selected video frame is undergoing a process of being stored in the video memory; and displaying the selected video frame, which is stored in the video memory, in the display panel a predetermined number of times by cycling the voltage level of the common voltage signal the predetermined number of times after the selected video frame has been fully stored in the video memory.

2. The method of claim 1, wherein selecting the video frame further comprises:

generating an internal data enable signal between vertical synchronization signals; and selecting the video frame based on the generated internal data enable signal in order to store the selected video frame.

3. The method of claim 2, wherein generating the internal data enable signal further comprises:

counting the M video frames;

determining the selected video frame from the M video frames based on a multiple of M; and generating the internal data enable signal based on the multiple of M.

4. The method of claim 1, wherein masking only the selected video frame further comprises outputting a blank video frame so as not to display the selected video frame in the display panel while the selected video frame is undergoing a process of being stored in the video memory.

5. The method of claim 1, wherein when 80 video frames are received per second externally, M corresponds to 4 and the predetermined number of times corresponds to 3 so that the number of the displayed video frames is 60.

6. The method of claim 1, wherein when 60 video frames are received per second externally, M corresponds to 4 and the predetermined number of times corresponds to 4 so that the number of the displayed video frames is 60.

7. A timing controller for displaying a landscape mode image, said controller comprising:

a video memory configured to store a video frame selected from a plurality of video frames received from an external source; and a driver controller coupled to said video memory, said driver controller configured to provide a common voltage signal having a regular cycle of high and low voltage levels during periods in which the selected video frame is not masked, but during periods in which the selected video frame is masked maintaining the common voltage signal at a previous high or low voltage level through a next voltage level cycle, such that the video frame is not displayed in a display panel while the video frame is undergoing a process of being stored into said video memory, said driver controller further configured to repeatedly display the video frame, which is stored in said video memory, in the display panel a predetermined number of times after the video frame has been fully stored in said video memory.

8. The timing controller of claim 7, further comprising:

a counter configured to count the video frames and configured to determine the video frame based on a multiple of the number of video frames so that said timing controller determines the video frame to be stored.

9. The timing controller of claim 7, wherein said driver controller masks the video frame such that the video frame is not displayed in the display panel while the video frame is undergoing a process of being stored into said video memory.

10. The timing controller of claim 9, wherein said driver controller masks the video frame to display a blank video frame.

11. The timing controller of claim 7, wherein when 80 video frames are received per second from said external source, M corresponds to 4 and the predetermined number of times corresponds to 3 so that the number of video frames displayed is 60.

12. The timing controller of claim 7, wherein when 60 video frames are received per second from said external source, M corresponds to 4 and the predetermined number of times corresponds to 4 so that the number of the displayed video frames is 60.

13. A mobile liquid crystal display (LCD) device for displaying a landscape mode image, comprising:

a display panel having a plurality of gate lines and a plurality of data lines;

a source driver coupled to said display panel and configured to drive the data lines;

a gate driver coupled to said display panel and configured to drive the gate lines of the display panel;

a driving voltage generator coupled to said gate driver and said display panel, said driving voltage generator configured to provide a common voltage signal to said display panel and further configured to provide a control voltage to the gate driver; and a timing controller configured to control a drive timing of the source driver, the gate driver and the driving voltage generator, said timing controller having a video memory configured to store a video frame that is selected from a plurality of video frames received from an external source and a driver controller configured to provide a common voltage signal having a regular cycle of high and low voltage levels during periods in which the selected video frame is not masked, but during periods in which the selected video frame is masked maintaining the common voltage signal at a previous high or low voltage level through a next voltage level cycle, such that the video frame is not displayed in the display panel while the video frame is undergoing a process of being stored into the video memory, and configured to repeatedly display the video frame, which is stored in the video memory, in the display panel a predetermined number of times after the video frame has been fully stored in said video memory.

14. The mobile LCD device of claim 13, wherein the timing controller further comprises:

a counter configured to count the video frames and to determine the video frame based on a multiple of the number of the video frames so that the timing controller determines the video frame to be stored.

15. The mobile LCD device of claim 13, wherein the driver controller masks the video frame such that the video frame is not displayed in the display panel while the video frame is undergoing a process of being stored into said video memory.

16. The mobile LCD device of claim 15, wherein the driver controller masks the video frame to display a blank video frame.

17. The mobile LCD device of claim 13, wherein when 80 video frames are received per second from an external source, M corresponds to 4 and the predetermined number of times corresponds to 3 so that the number of video frames displayed is 60.

18. The mobile LCD device of claim 13, wherein when 60 video frames are received per second from the exterior, M corresponds to 4 and the predetermined number of times corresponds to 4 so that the number of video frames displayed is 60.

* * * * *